United States Patent [19]

Millar et al.

[11] 4,182,206

[45] Jan. 8, 1980

[54] CYLINDRICAL MEMBER PROCESSING APPARATUS

[75] Inventors: Barry C. Millar, Islington; Keith W. Little, Georgetown, both of Canada

[73] Assignee: Bundy Corporation, Detroit, Mich.

[21] Appl. No.: 816,075

[22] Filed: Jul. 15, 1977

[51] Int. Cl.[2] ..... B26D 3/16; B26D 7/02

[52] U.S. Cl. ..... 83/56; 83/206; 83/277; 83/452

[58] Field of Search ..... 83/160, 206, 277, 56, 83/23, 452, 453; 198/19

[56] References Cited

U.S. PATENT DOCUMENTS

| | | | |
|---|---|---|---|
| 1,848,288 | 3/1932 | Welch | 83/160 X |
| 2,902,139 | 9/1959 | Brenk et al. | 198/19 |
| 3,353,818 | 11/1967 | Hill | 83/465 X |
| 3,512,438 | 5/1970 | Burdge | 83/277 X |

*Primary Examiner*—Willie G. Abercrombie

*Attorney, Agent, or Firm*—Harness, Dickey & Pierce

[57] ABSTRACT

There is disclosed herein a method and associated apparatus for processing groups of elongated cylindrical members such as tubing or the like. The cylindrical members are arranged and transversely clamped in a substantially flat array by a reciprocating clamp which operates to advance the array of cylindrical members a predetermined distance toward operation performing apparatus whereupon a second clamp engages the members and maintains them in the generally flat array while an operation is performed upon each of the members. Additional apparatus is provided which receives the cylindrical members longitudinally from the operation performing means and delivers the array transversely to other apparatus. Hold down means are also provided on this additional apparatus as well as on the operation performing means and reciprocating clamp means which are designed for rapid accurate adjustment to accommodate different diameter cylindrical members.

8 Claims, 13 Drawing Figures

Fig. 12.
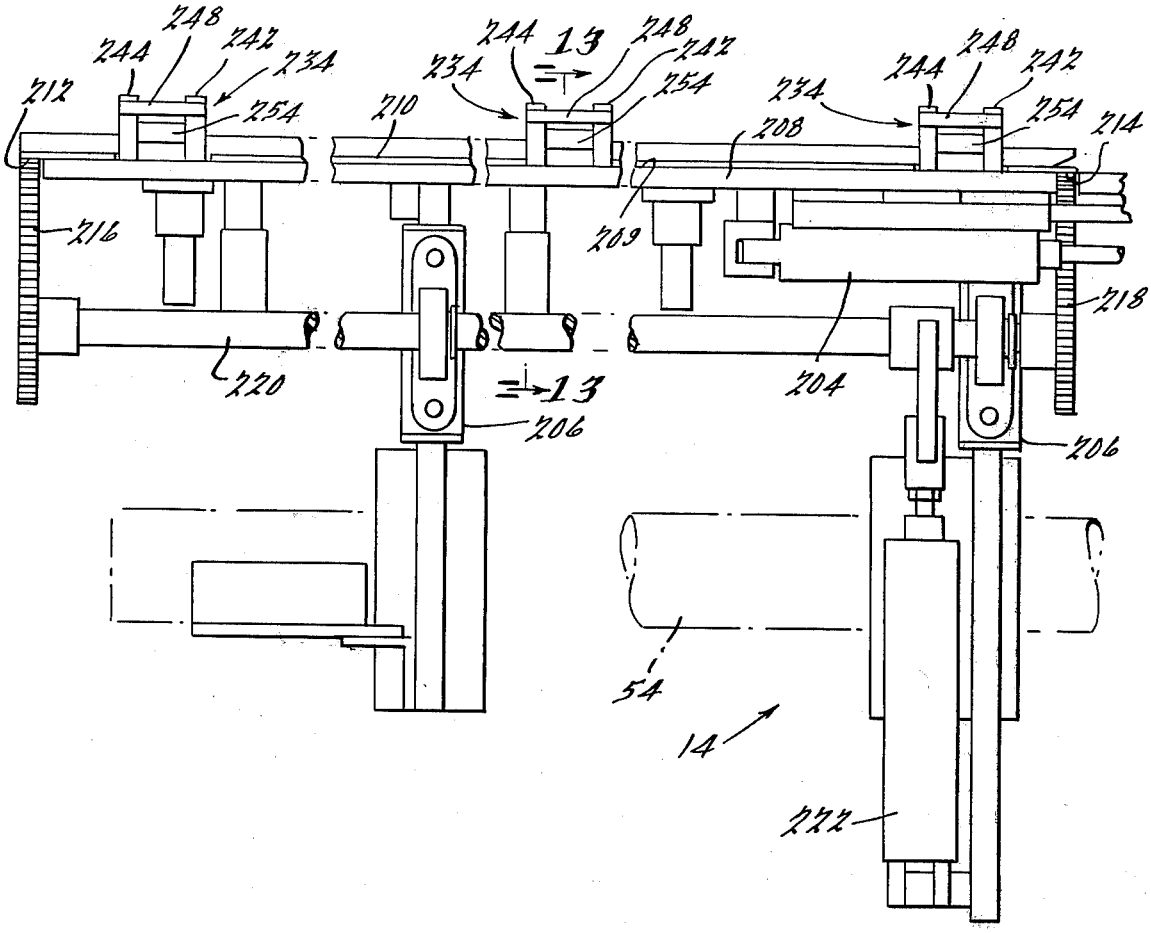
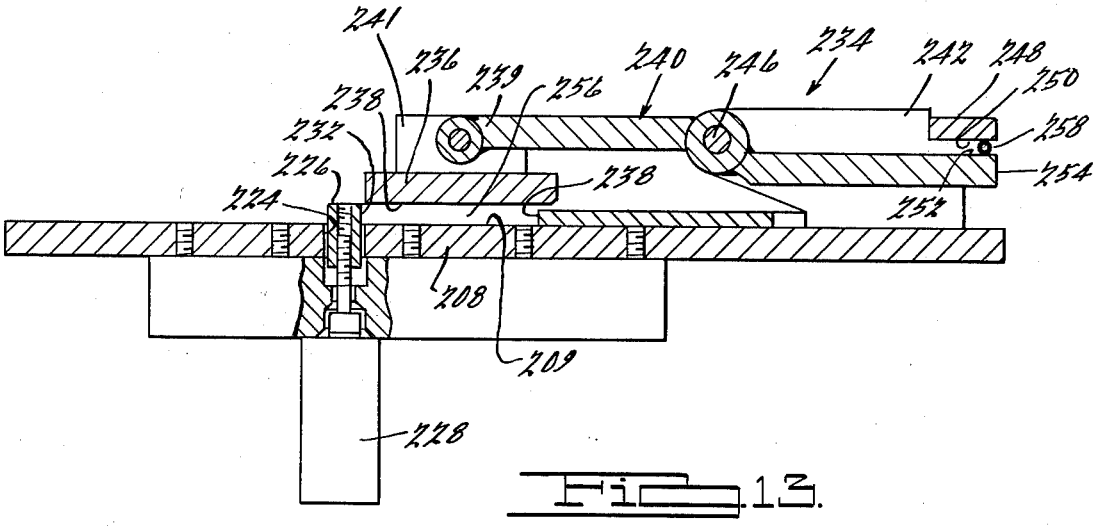
Fig. 13.

CYLINDRICAL MEMBER PROCESSING APPARATUS

BACKGROUND AND SUMMARY OF THE INVENTION

The present invention relates generally to cylindrical member processing apparatus and more specifically to such apparatus which is adapted to clamp, operate upon and transport a plurality of cylindrical workpieces such as tubing in a substantially flat array.

Numerous products require tubing in relatively large quantities such as automobiles, refrigeration apparatus or the like for a variety of applications such as fluid lines, coils, etc. These varied applications require tubes of various lengths and diameters to be subjected to a variety of manufacturing operations including cutting, shaping, applying end fittings and other such operations. As large quantities of such tubing members may be required in these applications, automated machinery has been developed for processing these tubes.

In order to fabricate these tubes, relatively long lengths of tubing, which may be received either as straight lengths of 100 or more feet or in coils of several thousand feet, must first be cut to length. In one form this has been accomplished by assembling a large number of such tubes in a bundle and then severing the appropriate lengths from the bundle. While this enables numerous lengths of tubes to be cut in a single operation, it is difficult to clamp the bundle of tubes as well as to advance the bundle for subsequent cuts. Further, the subsequent processing apparatus generally requires the cut tubes be handled individually. Thus, separate feed apparatus must be provided to receive these bundles and feed individual tubes to subsequent operation performing apparatus.

Another form of sectioning these lengths of tubing involves feeding a single tube member into cut off means which severs appropriate individual lengths thereof. Additional apparatus then advances each tube individually to subsequent processing equipment. While this eliminates the handling problems associated with the bundle cut off method described above, it requires a substantially greater amount of time as only a single length of tubing is severed at a time. Thus, problems are encountered in attempting to operate the cut off machinery at speeds sufficient to maintain an adequate supply to the subsequent processing apparatus.

Also, in both of the above operations, the apparatus requires relatively complex measurements, adjustments, test runs, etc., in order to alter production from one tubing length and/or diameter to another thus requiring substantial machine downtime.

Accordingly, the present invention provides apparatus which is uniquely adapted for high volume production of cylindrical members such as tubing or the like yet affords an extremely simple means for altering the lengths of tubing being processed as well as facilitating quick changeover from one diameter tubing to another without requiring any complex measuring or adjustment operations. Further, the present invention provides clamp means which enables groups of tubes to be processed simultaneously through the machine in a substantially flat array thereby facilitating feed to subsequent processing apparatus as well as enabling the feed apparatus to keep pace with subsequent operation performing means. Thus, the present invention offers a machine which is extremely flexible in that it is capable of handling tubing of a wide variety of lengths with equal ease and further incorporates features which allow production to be rapidly shifted from one size of tubing to another with a minimum of downtime. Further, the feed apparatus of the present invention also includes means for sensing the exhaustion of material supply thereto which means may be coupled to an alarm to alert the operator so as to enable him to replenish the material supply with minimal loss of production.

Additional advantages and features of the present invention will become apparent from the subsequent description and the appended claims taken in conjunction with the accompanying drawings.

BRIEF DESCRIPTION OF THE DRAWINGS

FIG. 12 is an enlarged front elevational view of the exit trap assembly illustrated in FIGS. 1 and 2 showing the transverse movement drive apparatus and associated hold down means; and FIG. 13 is a sectional view of the hold down means illustrated in FIG. 12, the section being taken along line 13—13 thereof.

DESCRIPTION OF THE PREFERRED EMBODIMENT

Figure 1:
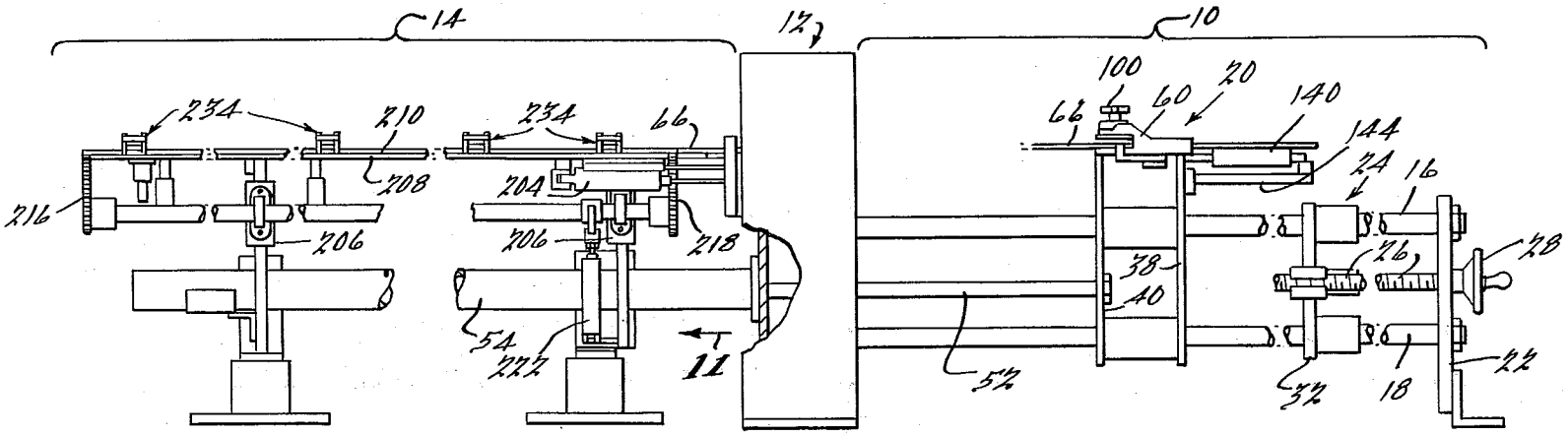
FIG. 1 is a front elevational view of the cylindrical member processing apparatus of the present invention with the guards removed therefrom.
Figure 2:
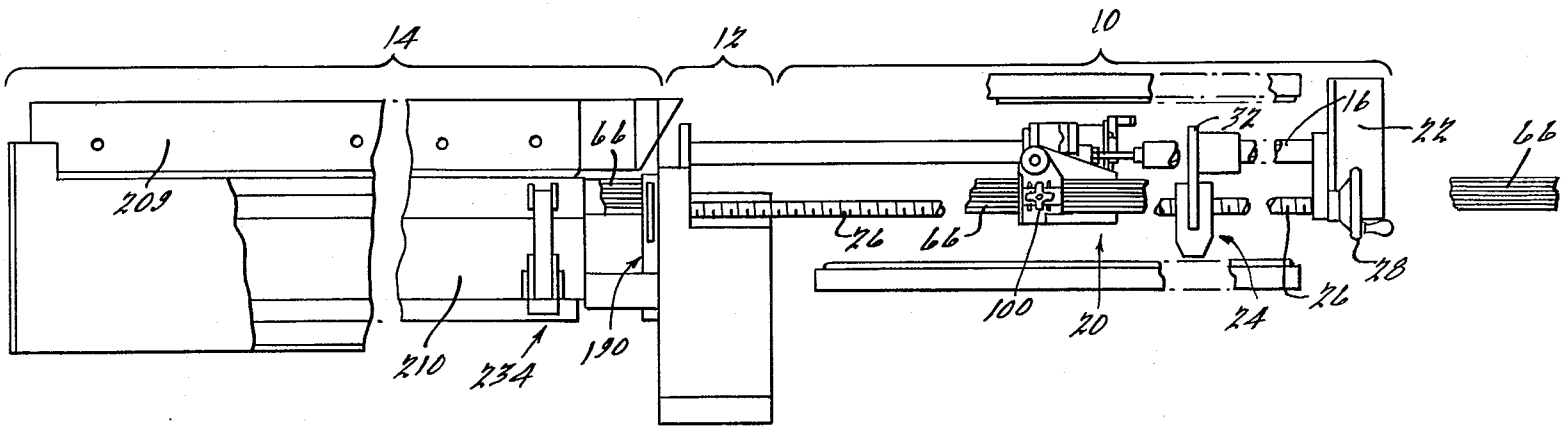
FIG. 2 is a plan view of the apparatus of FIG. 1.
Figure 3:
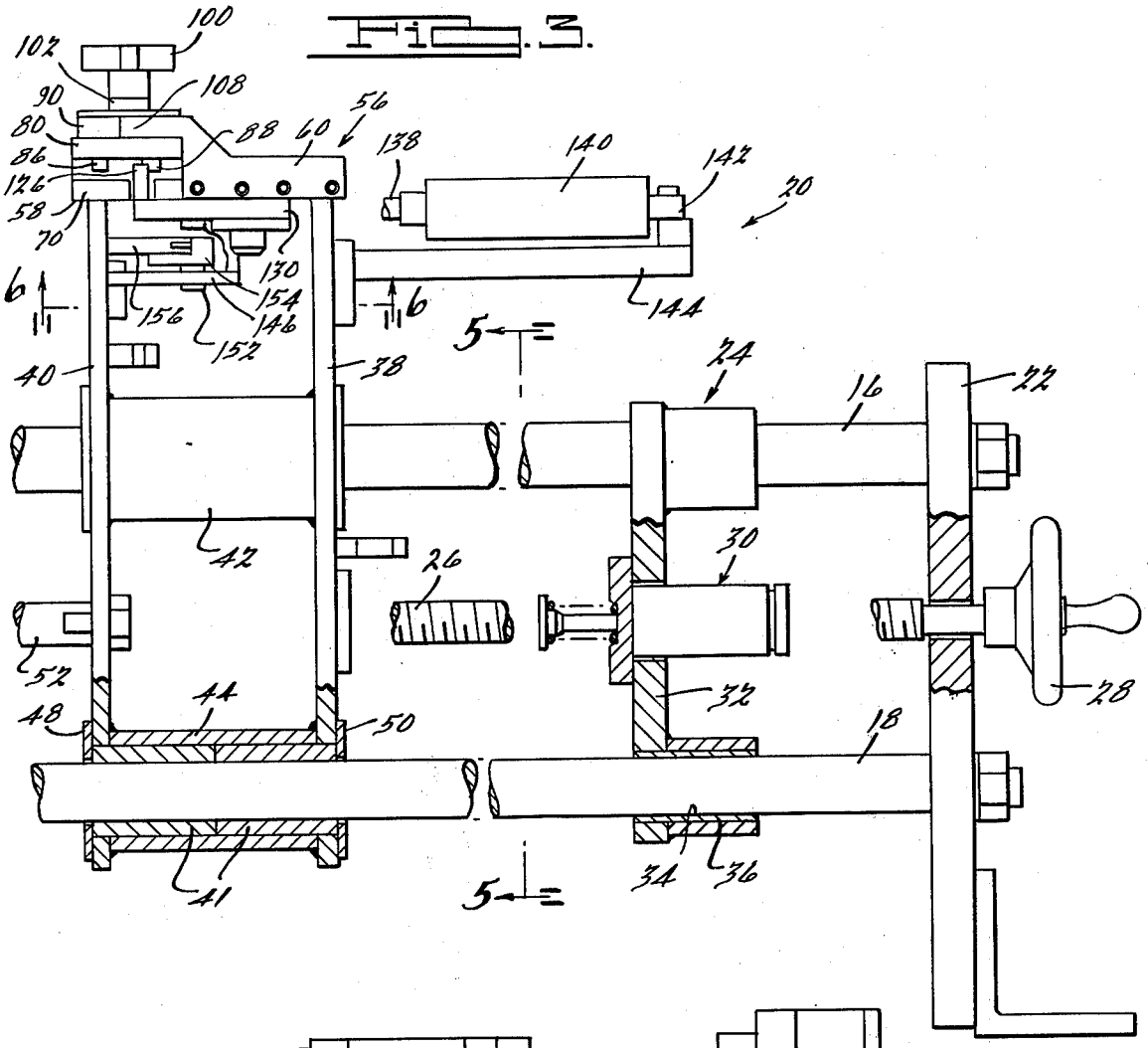
FIG. 3 is an enlarged detail view of the hitch feed portion of the present invention illustrating the reciprocating clamp apparatus with portions thereof broken away.

Referring now to the drawings and in particular to FIGS. 1 and 2, there is illustrated therein a cylindrical member processing apparatus particularly adapted for use in conjunction with tube processing apparatus such as that disclosed in our copending application filed on even date herewith bearing Ser. No. 816,074 assigned to the same assignee as the present invention and titled Apparatus For Processing Tubing. The cylindrical member processing apparatus of the present invention comprises a hitch feed assembly generally indicated at 10, a cut off assembly generally indicated at 12, and an exit trap assembly generally indicated at 14 all of which cooperate to sever appropriate lengths of tubing from a supply thereof and to advance these lengths to subsequent processing apparatus.

Hitch feed assembly 10 includes a pair of substantially parallel elongated guide bars 16 and 18 supported in a spaced substantially parallel relationship upon which a clamp assembly 20 is reciprocably supported. One end of each of elongated guide bars 16 and 18 is supportingly secured to an upstanding frame member 22 which may be secured to a suitable supporting surface such as a floor. The other end of each of guide bars 16 and 18 is secured to a portion of cut off assembly 12. A stop member 24 is also movably supported upon guide bars 16 and 18 and includes a threaded shaft 26 engaging a threaded portion thereof so as to enable stop means 24 to be adjustably positioned at any position therealong. Threaded shaft 26 is coextensive with guide bars 16 and 18 and rotatably supported in laterally spaced relationship thereto by upstanding frame member 22 and a portion of cut off assembly 12. A suitable hand wheel 28 is secured to one end thereof so as to enable rotation thereof for positioning of stop means 24.

Stop means 24 includes a shock absorbing means 30 secured to a portion thereof which is positioned to engage a portion of clamp assembly 20 so as to decelerate clamp assembly 20 as it is moved toward stop means 24. Stop means 24 includes a support structure 32 having a pair of spaced bores 34 extending therethrough which accommodate guide bars 16 and 18 each of which is provided with a bushing 36 so as to facilitate smooth movement thereof along the guide bars.

Clamp assembly 20 is best seen and will be described with reference to FIGS. 3 through 7. As previously mentioned, clamp assembly 20 includes a carriage frame comprising a pair of substantially parallel upstanding frame members 38 and 40 secured in a spaced apart relationship by upper and lower cylindrical members 42 and 44 through which guide bars 16 and 18 extend. Suitable ball bushings 46 are provided within each of cylindrical members 42 and 44 which bushings are retained therein by a pair of retaining rings 48 and 50 provided at opposite ends thereof. A piston rod 52 of a longitudinally extending air cylinder 54 is secured to frame member 40 and is adapted to reciprocate clamp assembly 20 along the guide bar members 16 and 18 as will be described in greater detail below.

Clamp apparatus 56 is supported upon the upper portion of the carriage assembly and is adapted to be reciprocated longitudinally therewith. Clamp apparatus 56 includes a base plate 58 extending between and secured to frame members 38 and 40 to which a pair of upwardly extending sidewall members 60 and 62 are secured in a substantially parallel spaced apart relationship so as to define a recess 64 therebetween which is adapted to receive a plurality of elongated cylindrical members 66. Base plate 58 is also provided with an arcuate shaped slot 68 opening out one edge 70 thereof which slot extends substantially the full distance between sidewall members 60 and 62.

Figure 4:
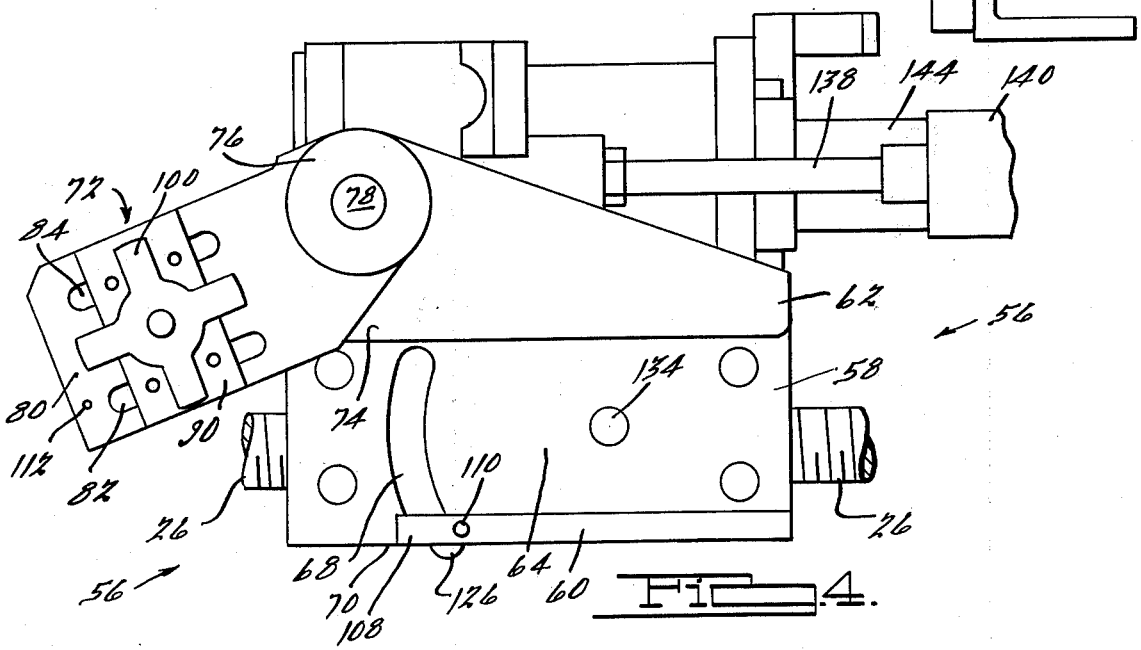
FIG. 4 is a plan view of a portion of the clamp apparatus illustrated in FIG. 3 showing the clamping means in an open position.
Figure 5:
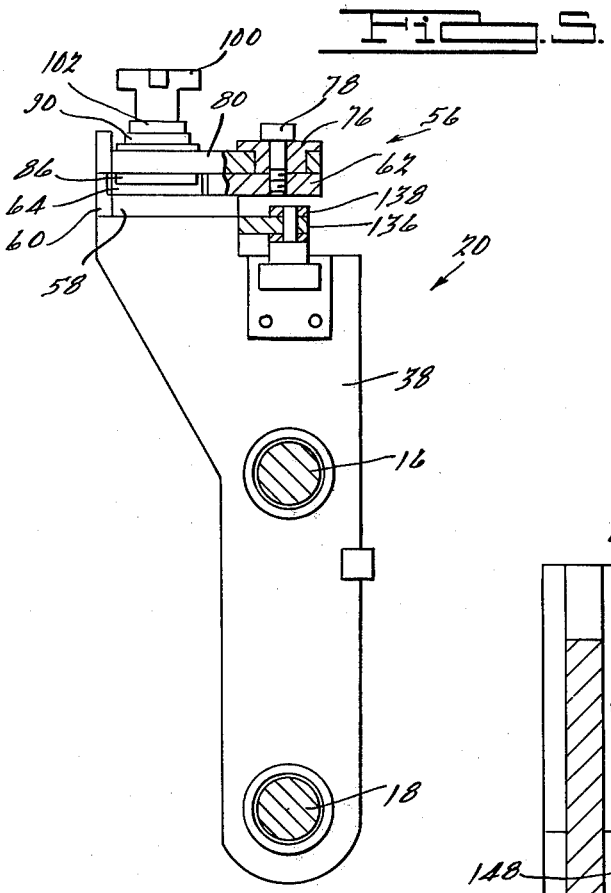
FIG. 5 is an end view in elevation of the clamp apparatus of the present invention.
Figure 7:
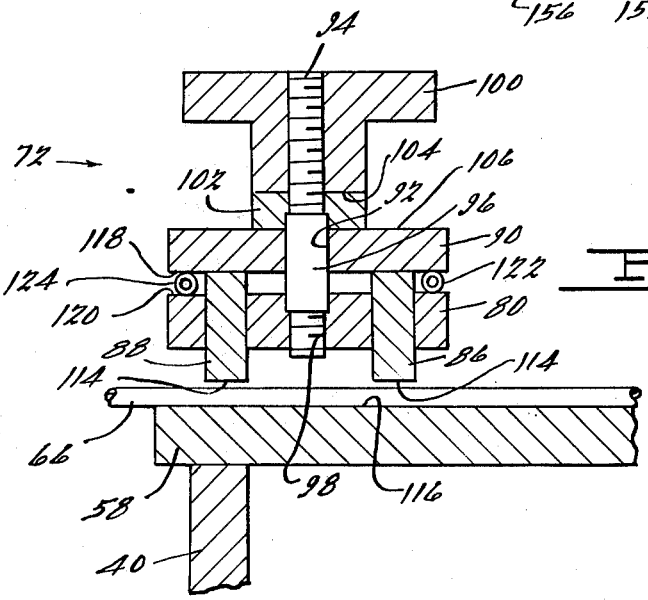
FIG. 7 is a sectional view of the adjustable hold down means employed in conjunction with the clamp arrangement of the present invention, the section being taken with the hold down means in a closed position along a vertical plane lying parallel to the longitudinal axis of the processing apparatus.
Figure 9:
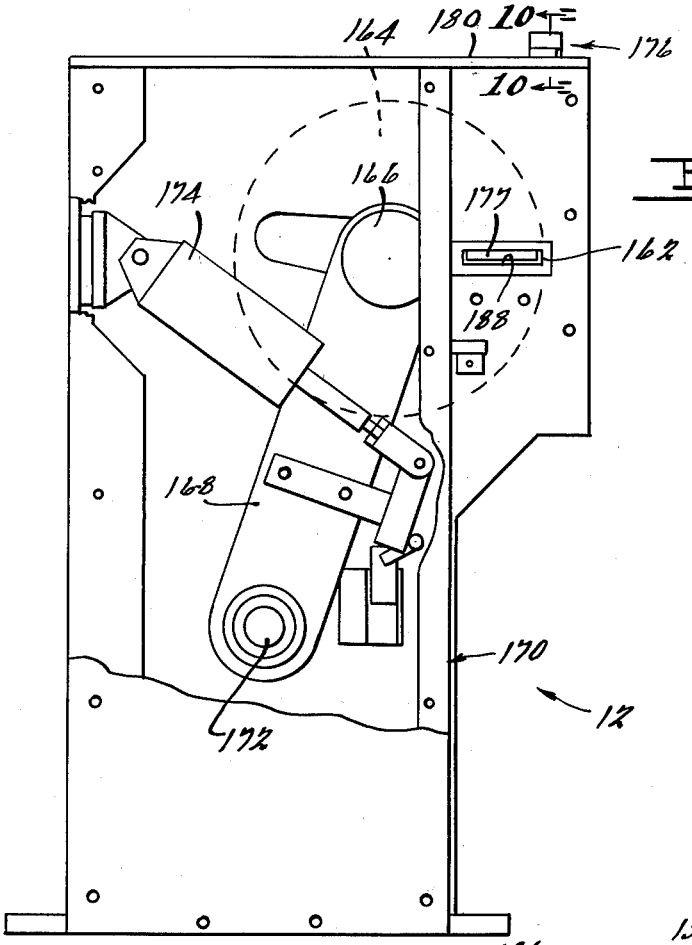
FIG. 9 is a side elevational view of cut off means associated with the tube processing apparatus of the present invention having a portion of the guard broken away.

Sidewall member 62 has a hold down assembly 72 pivotably secured to the upper surface 74 thereof through the agency of a bushing 76 and bolt 78. Hold down assembly 72 includes a tube hold down pivot block 80 having a pair of spaced apart substantially parallel elongated 82 and 84 provided therein through which a pair of tube hold down bars 86 and 88 extend. As best seen in FIG. 7, tube hold down bars 86 and 88 are interconnected by a tie-bar member 90 which has a centrally disposed bore 92 extending therethrough which is adapted to receive a threaded rod 94 and associated bushing member 96. Threaded rod 94 is fixedly secured within bore 98 provided in pivot block 80 and bushing 92 surrounds threaded rod 94 as it passes through tie-bar member 90 so as to guide movement of tie-bar member 90 with respect thereto. A suitable hand wheel 100 threadedly engages the upper end of threaded rod 94 and a suitable bearing means 102 is disposed between the lower surface 104 of hand wheel 100 and upper surface 106 of tie-bar 90 so as to enable hand wheel 100 to be easily rotated while exerting a downward pressure upon tie-bar member 90. As seen in FIG. 4, hold down assembly 72 is adapted to be pivoted about bushing 76 so as to enable a plurality of elongated cylindrical members 66 to be easily loaded into clamp apparatus 56. Thereafter the hold down assembly may be pivoted back into a closed overlying position with respect to the base plate 58. Sidewall 60 has an extended portion 108 which is provided with a spring detent 110. Extended portion 108 is adapted to overlie a portion of pivot block 80 and spring detent 110 will cooperate with a recess 112 on pivot block 80 to retain same in a closed position.

As illustrated in FIG. 7, tube hold down bars 86 and 88 each have a lower surface 114 which is in opposed relationship to the upper or support surface 116 of the clamp base plate 58. The spacing between the abutting surfaces 118 and 120 of tube hold down pivot block 80 and tie-bar member 90 respectively is slightly less than the spacing between lower surfaces 114 of the tube hold down bars 86 and 88 and the supporting surface 116 of base plate 58. Thus, hold down assembly 72 may be easily adjusted to accommodate any desired diameter tubing by merely inserting samples 122 and 124 of the tubing to be operated upon between the abutting surfaces 118 and 120. As opposed surfaces 114 of tube hold down bars 86 and 88 and 116 of base plate 58 will be spaced apart a small distance even when surfaces 118 and 120 of the tie-bar and pivot block are in engaging relationship a predetermined clearance is thereby maintained. This thus enables the hold down assembly assembly to be easily adjusted to accommodate any desired diameter workpieces.

Figure 6:
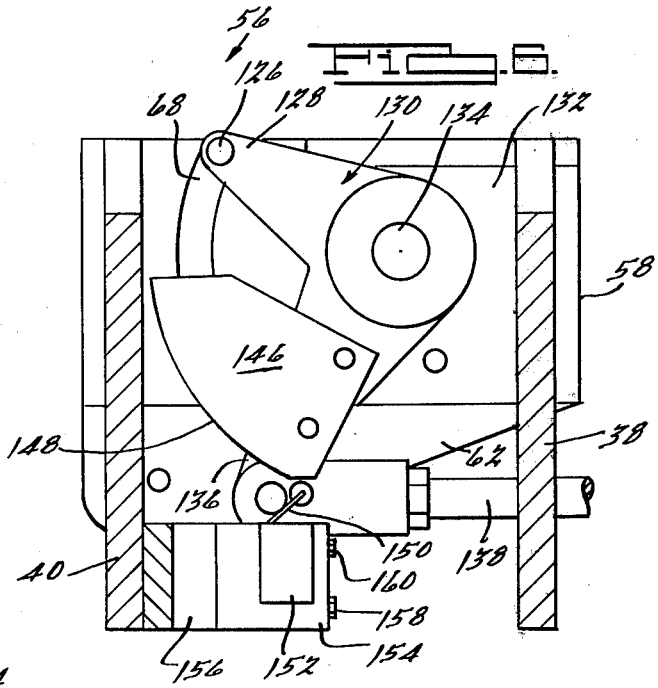
FIG. 6 is a sectional view of the clamp apparatus of the present invention showing the clamp actuating mechanism, the section being taken along line 6—6 of FIG. 3.

As best seen with reference to FIG. 6, clamp apparatus 56 also includes a pin member 126 adapted to move within slot 68 between the upwardly extending sidewall members 60 and 62. Pin member 126 is secured to one end 128 of a pivot arm 130 which is pivotably secured to the underside 132 of base plate 58 by pin 134. Pivot arm 130 has another end 136 to which is secured a piston rod 138 of an air powered operating cylinder 140 which operates to cause pin member 126 to move into clamping relationship with a plurality of elongated cylindrical members disposed within recess 64. Air cylinder 140 has an end portion 142 secured to a support arm 144 which is secured to a portion of the carriage assembly. Thus, as is apparent, as air cylinder 140 is caused to retract piston rod 138, pivot arm 130 will rotate moving pin member 126 toward sidewall portion 62 and thereby clamping cylindrical workpieces disposed within recess 64 therebetween.

Figure 8:
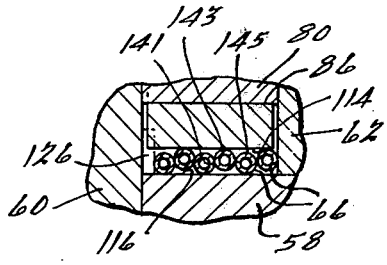
FIG. 8 is an enlarged sectioned detail view of the clamp apparatus of the present invention shown in clamping relationship to a plurality of cylindrical members, the section being taken along a transverse vertical plane.

As pin member 126 moves transversely into engagement with cylindrical members 66, it exerts a transverse pressure thereon. As hold down assembly 72 is positioned to provide a slight clearance between surfaces 114 thereof and surface 116 of base plate 58, the transverse movement of pin 126 into engagement with cylindrical members 66 will cause a slight bunching thereof such as is illustrated in FIG. 8. Thus, each of the cylindrical members will be subjected to three points 141, 143, and 145 of frictional engagement with either adjacent cylindrical members or adjacent apparatus surfaces.

A cam member 146 is also secured to pivot arm 130 and includes an arcuate surface 148 adapted to engage valve actuating means 150 which operates a limit valve 152 to indicate excessive travel of the pin member 126. This valve may be operatively connected to an alarm system so as to alert the operator that less than the desired number of cylindrical members are disposed within recess 64 of clamp apparatus 56 thus indicating an exhaustion of material. This therefore will enable the operator to shut down the machine and replenish the material supply immediately without requiring excessive delay of machine operation. Limit valve 152 is supported upon a pivot block 154 which is pivotably secured to a support block 156 extending outward from carriage frame member 40. A pair of set screws 158 and 160 are disposed in substantially parallel spaced apart relationship in pivot block 154 and engage support block 156 so as to enable pivot block 154 to be pivoted about its mounting point thereby enabling adjustment of the point of engagement between limit valve actuating means 150 and arcuate surface 148. This adjustment enables limit valve 152 to be easily positioned and to prevent false alarm due to the slight variance which may be encountered in processing tube members of different diameters.

Saw assembly 12 includes a generally rectangularly shaped slot 162 adapted to receive the cylindrically elongated members 66 in a flat array and has a saw blade 164 and associated drive mechanism 166 mounted upon a pivot arm 168 which pivot arm is supported in a saw housing 170 and adapted to pivot about pivot point 172 so as to bring saw blade 164 across slot 162. An actuating piston 174 is also provided which may be in the form of a pneumatic piston and is adapted to advance saw blade 164 and associated driving mechanism 166 into engagement with the cylindrical members extending through slot 162 provided therein. Adjustable hold down means is also provided and comprises a slidable member 176 slidably disposed within the saw housing 170 and having one end 177 projecting into slot 162 and another end 178 projecting outwardly from the top surface 180 of saw housing 170. End 178 has a laterally extending member 179 secured thereto which includes a lower surface 184 adapted to abut surface 180 of saw housing 170 and is adapted to receive a relatively short section 186 of a sample workpiece so as to position the lower end 177 in an appropriately spaced apart relationship with the lower supporting surface 188 provided within slot 162. Abutting surface 184 of slidable member 176 will be positioned relative to saw housing 170 so as to engage surface 180 while leaving end portion 177 of slidable member 176 in a spaced opposed relationship to supporting surface 188, which spaced relationship will be equal to the desired clearance to be afforded to workpieces as they pass through slot 162. Thus, when a workpiece is inserted between the abutting surface 184 and surface 180, the opposed surface of end 177 of slidable member 176 will be elevated from the supporting surface 188 a distance equal to the diameter of the workpiece to be processed therethrough plus the desired clearance. Thus, this provides a simple means of maintaining the desired clearance between the workpiece while facilitating rapid and quick and positive adjustment of the hold down means for different diameter workpieces.

Figure 10:
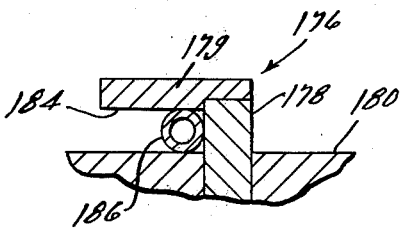
FIG. 10 is a detail sectional view of adjustable hold down apparatus provided on the cut off means, the section being taken along line 10—10 of FIG. 9.
Figure 11:
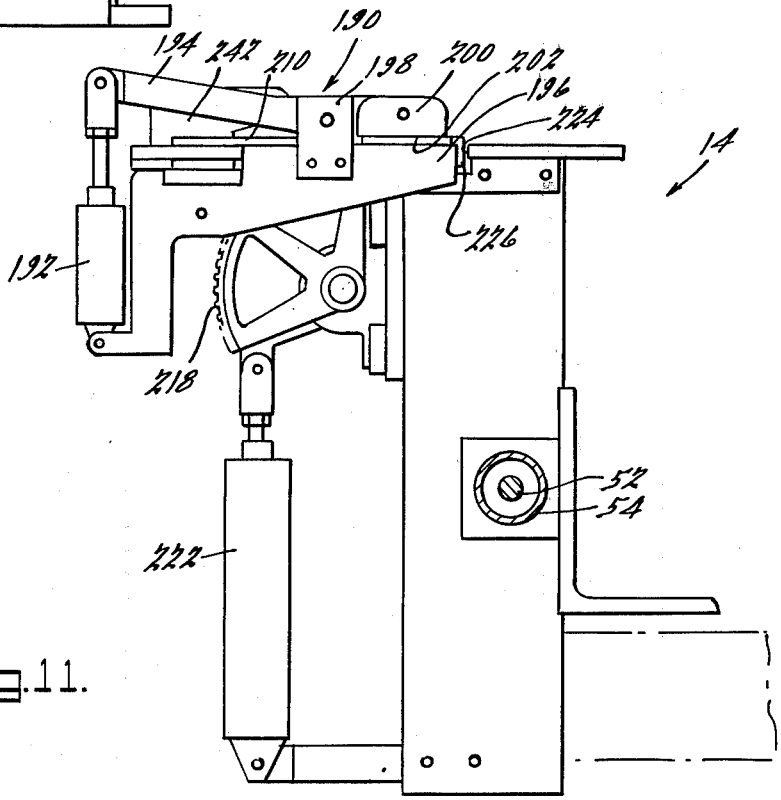
FIG. 11 is a side elevational view of the exit trap assembly of the present invention as viewed along arrow 11 of FIG. 1.

Referring now to FIGS. 10 through 12, exit trap assembly 14 is illustrated and will be described in detail. As illustrated in FIG. 10, a conventional clamp mechanism 190 is provided consisting of an operating air cylinder 192 attached to one end of a pivot arm 194 which is pivotably secured to support structure 196 by means of a support bracket 198. Pivot arm 194 includes an outwardly extending clamp member 200 at its opposite end which clamp member has a lower surface 202 adapted to engage the processed elongated cylindrical members so as to retain them in a substantially flat array. As seen in FIG. 12, clamp mechanism 190 is adapted to be reciprocated by means of pneumatic actuating piston 204 which is secured to the exit trap support structure 206. Thus clamp mechanims 190 enables the elongated members once having been severed by saw blade 164 to be withdrawn from slot 162 of saw housing 170 and moved longitudinally into position on exit trap assembly 14.

Exit trap assembly 14 comprises a generally elongated relatively large support member 206 having an upper supporting surface 209 on which is slidably supported a trap slide 210. Trap slide 210 comprises an elongated member having racks 212 and 214 provided at opposite ends thereof which engage pinions 216 and 218 provided on the end of a shaft 220 which is supported upon the exit trap support structure 206. Shaft 220 is adapted to be driven by any suitable means as an air operated piston 222 supported on the exit trap support structure 206 so as to cause trap slide 210 to reciprocate in a transverse direction. An elongated slot 224 is provided in support member 208 in which is disposed an elongated gate means 226 which extends in a substantially parallel spaced apart relationship to the trap slide 210. Gate means 226 is adapted to be reciprocated in a vertical direction by means of suitable piston means 228 disposed therebelow. Surfaces 230 an 232 of trap slide 210 and gate means 226 respectively cooperate to guide the elongated cylindrical members therebetween as they are advanced by clamp mechanism 190.

Hold down means 234 are also secured to support surface 209 in a spaced apart relationship. Hold down means 234 each include a pivot arm 240 having a pair of support blocks 241 pivotably secured to opposite lateral sides of one end 239 thereof which support blocks are secured to and support an elongated member 236 having a relatively flat lower surface 238 overlying and opposed to support surface 209. Pivot arm 240 is pivotably supported by a pair of spaced apart upwardly projecting members 242 ad 244 secured to support surface 209 of exit trap 14 by pin 246 extending through a portion thereof. A tie member 248 extends between the supporting arms and has a surface 250 substantially parallel to and adapted to abut surface 252 of another end 254 of the pivot arm 240. Tie member 248 will be positioned with respect to support surface 209 so as to engage the abutting surface 252 of pivot arm 240 so as to space surface 238 away from support surface 209 a predetermined distance when surface 250 and 252 of tie member 248 and end portion 254 of the pivot member respectively are in abutting relationship. This predetermined spacing will be equal to the desired clearance suitable to allow the workpieces to pass freely into position within area 256 defined by surfaces 209, 230, 232, and 238. Thus, similar to that previously described with respect to the clamp hold down means 72 and the saw hold down means, exit trap hold down means 234 may be easily adjusted to accommodate any diameter tubing by merely inserting a sample workpiece of tubing 258 between the abutting surfaces 250 and 252 of tie member 248 and end 254 of pivot arm 240. Thus, the opposed surface 238 of elongated member 236 will be spaced from the support surface 209 a distance equal to the sum of the diameter of the workpiece to be worked upon plus the predetermined desired clearance.

In order to operate the present invention, pivot block 80 of hold down assembly 72 will first be pivoted into an open position whereupon a predetermined number of elongated cylindrical members 66 will be placed in recess 64 thereof in a substantially parallel coplanar contiguous relationship. Cylindrical members 66 will then be advanced a sufficient distance to move their ends through slot 162 provided in the saw assembly 12 and beyond saw blade 164. Hold down assembly 72 may then be moved to a closed position. Thereafter, suitable sample cylindrical members of the same diameter as cylindrical members 66 inserted within recess 64 of clamp assembly 20 will be placed between the abutting surfaces 118 and 120 of hold down assembly 72 as well as between surfaces 180 and 184 of saw assembly 12 and the abutting surfaces 250 and 252 of the hold down means 234 provided on the exit trap 14. Thereafter, hold down means 72 may be adjusted by rotating hand wheel 100 so as to move hold down bars 86 and 88 into the appropriate spaced apart relationship suitable to provide the appropriate clearance for movement of the cylindrical members therethrough. It should be noted that clamp assembly 20 will necessarily be in a retracted position engaging stop means 24. Stop means 24 will be positioned from the saw blade 164 a distance equal to the desired lengths into which tubing 66 is to be severed. Clamp mechanism 190 provided on exit trap 14 will then be brought into clamping engagement with end portions of cylindrical members 66 and pivot arm 168 will index saw blade 164 forward so as to sever end portions of each of the cylindrical members 66. This step insures that each of the tubular members will extend an equal distance beyond the reciprocating clamp member and thus will insure that all the lengths of tubes will be of an equal length. Thereafter, piston 140 is actuated causing pivot arm 130 to bring pin 126 transversely toward sidewall 60 thereby clamping cylindrical members 66 in a bunched substantially flat array therebetween. As illustrated in FIG. 8, each of the cylindrical members will have at least three points of frictional engagement which will insure secure clamping even in slight variations in diameter is encountered between the cylindrical members. Once the cylindrical members have been securely clamped, the reciprocal clamp member will then advance forward until it comes into engagement with stop means adjacent saw assembly 12 which advancement will cause cylindrical members 66 to move through slot 162 of saw assembly 12 into exit trap 14. At this point, clamp 190 will engage the flat array of cylindrical members after which the pin 126 of clamp assembly 20 will be released. Clamp assembly 20 will then traverse back until it engages adjustable stop means 24. Thus, we have now advanced a predetermined length of the group of cylindrical members beyond the saw blade. Clamp 190 will remain in engagement clamping the cylindrical members in a substantially flat array while saw blade 164 is indexed forward into engagement and severs this predetermined length of each of the cylindrical members from the raw material supply. Thereafter, clamp 190 will advance toward exit trap 14 causing the group of elongated cylindrical members to move longitudinally into the exit trap assembly being guided therein by the trap slide 210, elongated member 236, and gate means 226. Clamp member 190 will remain in clamping relationship with the tubular members while they are retained in position between support surface 209, trap slide 210, gate means 226 and overlying elongated hold down member 236. When the group of cylindrical members is required for further processing, gate means 226 will be retracted whereupon trap slide 210 will be actuated by cylinder 222 causing rotation of the pinion gears 216 an 218 engaging racks 212 and 214 provided on opposite ends thereof. Trap slide 210 will thus cause the cylindrical members to advance out from beneath hold down member 236 and into position for feed to subsequent processing apparatus to which the present invention may be operatively associated. Additional groups of cylindrical members may thereafter be severed as needed by merely advancing reciprocal clamp 20 and repeating the subsequent above described steps.

There is thus described a cylindrical tube processing apparatus particularly adapted for use in fabrication of tubing of various lengths which is extremely flexible in that it enables large quantities of tubing to be rapidly severed from elongated supplies of raw material which lengths may be easily and quickly changed by merely adjusting the adjustable stop means which controls the distance of reciprocal movement of the clamp means. Further, as the clamp means are designed to securely clamp the tubular members in a substantially flat coplanar contiguous array, a plurality of tubes may be cut with a single pass of the saw thereby facilitating an adequate supply thereof to the subsequent processing apparatus. Thus, by means of the above described clamping apparatus in conjunction with the exit trap assembly which receives material in a longitudinal direction and supplies this material transversely to additional processing apparatus, the present invention allows rapid fabrication of cylindrical members for any desired purpose.

While it will be apparent that the preferred embodiment of the invention disclosed is well calculated to provide the advantages and features above stated, it will be appreciated that the invention is susceptible to modification, variation and change without departing from the proper scope of fair meaning of the subjoined claims.

We claim:

1. A method of processing a plurality of elongated generally cylindrical members through apparatus for performing an operation on said members, said apparatus including operation performing means and a movable clamp assembly, said clamp assembly comprising a pair of relatively movable clamping surfaces and a pair of relatively movable holding surfaces, said method comprising:

placing a plurality of said elongated generally cylindrical members in a substantially flat parallel coplanar contiguous array within said clamp assembly and between said pairs of surfaces;

positioning and thereafter maintaining said holding surfaces apart a distance equal to the diameter of said members plus a predetermined clearance whereby said members are maintained in said substantially flat array;

actuating said clamping surfaces into clamping engagement with said members;

moving said clamp assembly in a direction so as to transport said members into said operation performing means; and performing an operation on said members while continuing to maintain said clamping surfaces in clamping engagement with said members whereby they are retained in said substantially flat array.

2. A method as set forth in claim 1 further including a pair of opposed relatively movable positioning surfaces associated with said holding surfaces and wherein positioning said holding surfaces comprises placing a sample of one of said cylindrical members between said positioning surfaces.

3. A method as set forth in claim 1 further comprising advancing end portions of said members into said operation performing means, and performing an initial operation on said flat array subsequent to actuating said clamping surfaces and prior to transporting said flat array.

4. A method as set forth in claim 3 wherein said operation comprises severing end portions from each of said elongated cylindrical members.

5. A method as set forth in claim 3 wherein said clamping surfaces and said holding surfaces are positioned at right angles thereto and actuating said clamp assembly comprises moving a clamp member transversely into engagement with said array so as to clamp said array.

6. A method as set forth in claim 1 wherein said apparatus further comprises a second clamp assembly and said method further includes restraining said flat array with said second clamp means subsequent to transporting said raw material to said operation performing means.

7. A method as set forth in claim 6 further comprising releasing said second clamp and transversely moving said flat array toward subsequent operation performing means.

8. A method as set forth in claim 7 further comprising moving said second clamp means so as to longitudinally withdraw said flat array from said operation performing means subsequent to performing said operation and prior to releasing said second clamp from said array.

* * * * *